US009931625B2

(12) United States Patent
Voyeux et al.

(10) Patent No.: US 9,931,625 B2
(45) Date of Patent: Apr. 3, 2018

(54) EJECTION FUNCTION FOR A POSITIVE-DISPLACEMENT PIPETTING SYSTEM

(71) Applicant: GILSON SAS, Villiers-le-Bel (FR)

(72) Inventors: Claude Voyeux, Goussainville (FR); Stephane Guichardon, Bougival (FR)

(73) Assignee: GILSON SAS, Villiers le Bel (FR)

( * ) Notice: Subject to any disclaimer, the term of this patent is extended or adjusted under 35 U.S.C. 154(b) by 207 days.

(21) Appl. No.: 14/779,518

(22) PCT Filed: Mar. 21, 2014

(86) PCT No.: PCT/EP2014/055769

§ 371 (c)(1),
(2) Date: Sep. 23, 2015

(87) PCT Pub. No.: WO2014/154594

PCT Pub. Date: Oct. 2, 2014

(65) Prior Publication Data

US 2016/0051978 A1 Feb. 25, 2016

(30) Foreign Application Priority Data

Mar. 25, 2013 (FR) ..... 13 52660

(51) Int. Cl.
*B01L 3/02* (2006.01)

(52) U.S. Cl.
CPC ..... *B01L 3/022* (2013.01); *B01L 3/0279* (2013.01); *B01L 2200/04* (2013.01);
(Continued)

(58) Field of Classification Search
None
See application file for complete search history.

(56) References Cited

U.S. PATENT DOCUMENTS 3,525,264 A 8/1970 Nieglos et al.
4,050,316 A * 9/1977 Rapoza ..... B01L 3/022 422/924

(Continued)

FOREIGN PATENT DOCUMENTS

DE 2647883 5/1977
DE 10 2008 058 067 A1 5/2010

(Continued)

OTHER PUBLICATIONS

Preliminary French Search Report for FR 1360906 (dated Jul. 30, 2014).

(Continued)

*Primary Examiner* — Jill A Warden
*Assistant Examiner* — Brittany I Fisher
(74) *Attorney, Agent, or Firm* — Miles & Stockbridge P.C.

(57) ABSTRACT

A bottom part of a positive-displacement pipetting system), including a body slideably housing a device for gripping a piston belonging to a capillary-piston assembly the capillary of which is adapted to be fitted onto an end-fitting of the body. The system also comprises means for ejecting the capillary-piston assembly arranged externally with respect to the body. The system is constructed so that a relative rotation between the ejection means and the gripping device causes it to pass from an open configuration enabling the piston to be released to a closed configuration enabling said piston to be retained, and/or the reverse.

15 Claims, 15 Drawing Sheets

(52) U.S. Cl.
CPC ..... *B01L 2300/0609* (2013.01); *B01L 2300/0838* (2013.01); *B01L 2400/0478* (2013.01)

(56) References Cited

U.S. PATENT DOCUMENTS

| | | | | |
|---|---|---|---|---|
| 4,099,548 | A | 7/1978 | Sturm et al. | |
| 4,154,108 | A * | 5/1979 | Vollinger | B01L 3/0224 422/925 |
| 4,362,064 | A * | 12/1982 | Marteau d'Autry | B01L 3/0279 422/923 |
| 4,474,071 | A * | 10/1984 | Marteau d'Autry | B01L 3/0279 422/923 |
| 4,567,780 | A | 2/1986 | Oppenlander | |
| 4,616,514 | A | 10/1986 | Magnussen, Jr. et al. | |
| 4,830,832 | A | 5/1989 | Arpagus et al. | |
| 5,021,217 | A * | 6/1991 | Oshikubo | B01L 3/0217 422/516 |
| 5,413,006 | A * | 5/1995 | D'Autry | B01L 3/0224 422/925 |
| 7,320,260 | B2 | 1/2008 | Belgardt | |
| 2005/0155438 | A1 * | 7/2005 | Belgardt | B01L 3/0217 73/864.01 |
| 2011/0076205 | A1 * | 3/2011 | Kelly | B01L 3/0279 422/525 |
| 2014/0298925 | A1 | 10/2014 | Voyeux et al. | |
| 2016/0051978 | A1 | 2/2016 | Voyeux et al. | |

FOREIGN PATENT DOCUMENTS

| | | | |
|---|---|---|---|
| EP | 0014120 | A1 | 8/1980 |
| EP | 032469 | | 7/1981 |
| EP | 0078724 | A1 | 5/1983 |
| FR | 2446672 | A1 | 8/1980 |
| FR | 2980123 | A1 | 3/2013 |
| JP | 4225845 | | 8/1992 |

OTHER PUBLICATIONS

International Search Report for PCT/EP2014/073631 (dated Aug. 1, 2015).
Office Action dated Jul. 18, 2016 for related U.S. Appl. No. 14/345,294.
Office Action dated Feb. 9, 2017 for related U.S. Appl. No. 14/345,294.
International Search Report dated May 8, 2014 for International Application No. PCT/EP2014/055769.
French Search Reporting dated Feb. 3, 2014 for French Application No. 1352660.
International Search Report and Written Opinion issued in PCT/EP2012/068294, dated Dec. 11, 2012.
International Preliminary Examination Report issued in PCT/EP2012/068294, dated Sep. 10, 2013.
English language translation of the International Preliminary Examination Report issued in PCT/EP2012/068294, dated Sep. 10, 2013.
Notice of Allowance dated Jul. 5, 2017 for related U.S. Appl. No. 14/345,294.
Non-Final Office Action dated Jun. 30, 2017 for related U.S. Appl. No. 15/034,833.
Notice of Allowance dated Jan. 25, 2018 for related U.S. Appl. No. 15/034,833.

* cited by examiner

EJECTION FUNCTION FOR A POSITIVE-DISPLACEMENT PIPETTING SYSTEM

TECHNICAL FIELD

This invention relates to the field of positive-displacement pipetting.

Such systems are intended to cooperate with consumables of the capillary-piston type, in which the piston is intended to be directly in contact with the sample to be collected, before being ejected or reused. Positive-displacement systems therefore have a different design from that of more conventional air-displacement systems, in which the piston is an integral part of the system.

The invention more specifically relates to the ejection function of the capillary-piston assembly. It applies to all different types of sampling systems, namely, in particular, pipettes, manual or powered, as well as automated systems.

PRIOR ART

Positive-displacement pipettes are normally used for sampling viscous, volatile or contaminating liquids. Their association with consumables of the "capillary-piston" type makes it possible to avoid contamination of the pipette. The same is true of automated systems operating according to the same principle.

Such a positive-displacement pipette is known from the French patent application FR 2 446 672.

The positive-displacement pipettes known from the prior art are provided with a control rod, the bottom end of which controls the displacement of a gripping device of the top end of a piston, belonging to a capillary-piston assembly intended to cooperate with the pipette. This gripping device is also called a "clamp".

The pipette is designed so as to be capable of exerting two successive downward strokes with the control rod, via a control button arranged at its top end. The first stroke of the control rod corresponds to the stroke for dispensing the collected sample. It is performed by opposing the return force of a first spring, preferably a compression force. The second stroke of the control rod corresponds to the presentation and opening of the gripping clamp of the piston. It is performed by opposing the return force of a second spring, preferably a compression force, arranged in the same direction as the first spring and having a stiffness that is clearly greater.

More specifically, this second stroke results causes the jaws/jaw assembly of the clamp to be extracted from a sheath surrounding them. Once the jaws have been released from their sheath, they may easily allow penetration of the top end of the piston during installation of the consumable on the pipette, simultaneously allowing the fitting of the capillary on the end-fitting of the pipette.

The first phase of raising the control rod, under the effect of the return force of the second spring, causes the jaws to be retracted into the sheath of the clamp, with the top end of the piston held by the jaws in the clamped position. The second phase of raising the control rod, under the effect of the return force of the first spring of lesser stiffness, causes the displacement of said rod as well as of the clamp holding the piston until it reaches the top position, with respect to the pipette body.

In order to perform a sample collection, the operator must again perform the first stroke of the control rod with the piston attached, until the first spring is totally compressed, bringing the piston to its bottom collection point. A continuation of the stroke at this stage, i.e. an accidental initiation of the second stroke against the second spring, would cause an excessive downward displacement of the piston, and would lead to an error in the quantity of sample collected. An excessive over-stroke of the piston could even lead to the accidental ejection of the piston and the capillary, due to the release of the jaws of the clamp by the sheath surrounding them, and the bearing of said jaws on the capillary. Such an ejection is not only problematic in terms of productivity, but also causes non-negligible risks of liquid spray when the capillary-piston assembly falls into a liquid container.

When the piston has reached its bottom point at the end of the first stroke, the consumable is immersed in the liquid to be collected. To perform the collection, the operator then progressively relaxes the pressure exerted by his or her thumb on the control button, enabling the control rod and the piston to rise under the effect of the return force of the first spring. During this rise, the liquid in contact with the bottom end of the piston is inserted into the capillary.

For the dispensing, the operator again performs the first stroke of the control rod by pressing his or her thumb on the control button, placing the capillary in the container intended to receive the liquid. Again, in the event of an over-stroke of the piston, it risks being accidentally ejected with the capillary, thus again generating a risk of accidental spray of liquid.

Finally, once the operation of dispensing the liquid is completed, the operator may perform the second stroke of the control rod in order to cause the desired ejection of the capillary-piston consumable. Nevertheless, this ejection operation is performed using a single thumb of the operator, countering the return force of the second spring, which is necessarily substantial in order to oppose the return force of the first spring, and thus be capable of ensuring its function of delivering a sensory signal to the operator at the end of the first stroke. The high stiffness of the second spring thus makes the pipette perfectible in terms of ergonomics, especially because this disadvantage also occurs during the above-described operation of opening the clamp, before insertion of the piston.

At least some of the disadvantages cited above are found in an identical or analogous manner in the current automatic positive-displacement pipetting systems.

In addition, another disadvantage of the ejection system provided on the positive-displacement pipettes currently known is that it is based on a design far removed from that of the ejection system for conventional air-displacement pipettes. As operators are generally more accustomed to using such air-displacement pipettes, there is a need to harmonize the design of the ejection system of positive-displacement pipettes.

OBJECT OF THE INVENTION

The invention is therefore intended to at least partially overcome the disadvantages mentioned above, involving the embodiments of the prior art.

To this end, the invention relates to a bottom part of a positive-displacement pipetting system, including a body slideably housing a gripping device of the top end of a piston belonging to a capillary-piston assembly, the capillary of which is intended to be fitted onto an end-fitting of the body. According to the invention, the bottom part also comprises means for ejecting the capillary-piston assembly arranged outside said body and slideably mounted with respect to the body according to a longitudinal axis of the pipetting system, so as to be capable of cooperating with said capillary for the ejection thereof. In addition, the bottom part is designed so that a relative rotation between the ejection means and the gripping device, according to the longitudinal axis of the pipetting system, causes the gripping device to pass from an open configuration enabling the top end of the piston to be released, to a closed configuration enabling said end to be held, and/or to pass from the closed configuration to the open configuration.

The invention is notable in that it is based on a design making it possible to dissociate the elements ensuring the control function of the pipette from those ensuring the ejection of the capillary-piston consumable. More specifically, according to the invention, the ejection of the consumable is performed by dedicated ejection means surrounding the body of the bottom part, in the same was as similar ejection means commonly seen on air-displacement pipettes. Consequently, unlike the embodiments of the prior art in which the ejection means integrate the control rod, the risks of accidental ejection of the consumable by said same control rod are advantageously reduced to none.

Thus, during handling of the pipette, the operator may actuate the control rod without being concerned with risks of such a loss, thereby generally making it possible to generally improve ergonomics, reproducibility of collections, and productivity. This is also the case when the invention is applied to an automated positive-displacement sampling system.

In addition, the force to be delivered in order to ensure the ejection of the consumable may be much lower than that previously required in order to counter the return force of the spring having a high stiffness, since it is no longer necessary to provide a high differential of spring stiffnesses in order to provide a sensory signal for the operator. Moreover, the low bearing force required in order to detach the capillary from the end-fitting of the pipette has no effect on the risk of accidental loss of the capillary-piston consumable, as explained above. This force is also low due to the possibility of bringing the gripping device into an open configuration during ejection of the piston-capillary assembly. Therefore, during the ejection, which occurs like a conventional ejection on an air-displacement pipette, there is no need to counter the friction force between the top end of the piston and the clamp. This results in better ergonomics for the operator.

The relative rotation between the ejection means and the gripping device may be performed in different ways. A solution consisting in manually rotating the ejection means may be envisaged, but an automation of this movement is preferred. This automation is preferably performed by mechanical movement converting means, as will be described in examples below. For this, mechanical connections of the ramp/pin type are preferably implanted on the bottom part of the pipetting system according to the invention.

Preferably, the gripping device has a jaw that is mobile between a first position bringing the device into the closed configuration and a second position bringing the device into an open configuration, the jaw comprising one of the two elements among the first pin passing through said body and a first ramp cooperating with the first pin, the other of the two elements being provided on said ejection means. In addition, the passage of the jaw from the first position to the second position, and the reverse, is performed by a relative displacement of the first pin along said first ramp.

Preferably, said gripping device is equipped with resilient return means returning the mobile jaw to its first position or to its second position.

Preferably, the gripping device comprises one of the two elements among a second pin passing through said body and a second ramp cooperating with the second pin, the other of the two elements being provided on said ejection means. In addition, the bottom part of the pipetting system is designed so that, during a downward displacement of the gripping device, the latter passes from the open configuration to the closed configuration by a relative rotation between the ejection means and the gripping device caused by the relative displacement of the second pin along said second ramp. It is preferably this relative rotation that causes said jaw to pass from its first position to its second position.

Preferably, the second ramp is designed so that, after passing into the closed configuration of the gripping device, this closed configuration is maintained as the gripping device rises. A pipetting sequence can then be implemented using conventional pipette control means.

Preferably, said body comprises one of the two elements among a third pin and a third ramp cooperating with the third pin, the other of the two elements being provided on said ejection means. In addition, the bottom part of the pipetting system is designed so that, during a downward displacement of the ejection means, said gripping device is brought from the closed configuration to the open configuration by rotation of the ejection means with respect to said body, caused by the relative displacement of the third pin along said third ramp. In addition, this makes it possible to obtain a helical displacement of the ejection means by applying a simple downward translation movement on them. The thrust of the capillary and the release of the piston are therefore performed simultaneously, for perfectly optimized ergonomics.

Preferably, the third ramp is designed so that, after passing into the open configuration of the gripping device, this open configuration is maintained as the ejection means rise. Consequently, the gripping device advantageously remains in the open configuration, ready to cooperate with a new capillary-piston assembly.

Preferably, the first, second and third ramps are provided on the interior surface of the ejection means. Alternatively, they may be placed, at least one, on the body and/or the gripping device.

Preferably, said ejection means include a ring surrounding the body and rotatably bearing an ejection sheath also surrounding the body. It is thus said sheath that is intended to be capable of pivoting with respect to the gripping device, in order to bring the latter into the open or closed configuration. In this regard, it is indicated that the aforementioned relative rotation is preferably performed by rotation of the ejection means about the longitudinal axis of the pipetting system, keeping, according to said same axis, the gripping device locked in rotation. A reverse technical solution may, however, be envisaged, without going beyond the scope of the invention. Similarly, a mixed solution in which the ejection means and the gripping device turn in opposite directions is also possible.

The invention also relates to a positive-displacement pipetting system including a bottom part as described above.

Preferably, it is a pipette, manual or powered, comprising a top part forming a handle equipped with an ejection button connected to said ejection means. In this case, said ejection button is preferably distinct from a control button for displacement of the piston.

Alternatively, the pipetting system may be an automated system.

The invention also relates to a pipetting method using a positive-displacement pipetting system as described above, including the following successive steps:

(a) fitting the capillary of the capillary-piston assembly onto an end-fitting of the pipetting system, and inserting the top end of the piston of the assembly into the gripping device during the displacement thereof into a bottom position, during which insertion a relative rotation is performed between said ejection means and the gripping device in order to bring the latter from the open configuration to the closed configuration, so as to retain the top end of the piston;

(b) collection and dispensing of a sample by actuating a control rod connected to the gripping device;

(c) ejection of the capillary-piston assembly by a downward displacement of said ejection means thrusting the capillary, during which ejection a relative rotation is performed between said ejection means and the gripping device in order to bring the latter from the closed configuration to the open configuration, releasing the top end of the piston.

Preferably, for step (a), said relative rotation between said ejection means and the gripping device is performed automatically as the gripping device descends, and, for step (c), said relative rotation between said ejection means and the gripping device is performed automatically as the ejection means descend. As mentioned above, if the desired automation can take any form considered to be appropriate by a person skilled in the art, it is preferably implemented by mechanical movement conversion means such as mechanical connections of the ramp/pin type or the like.

Other advantages and features of the invention will become clear in the non-limiting detailed description below.

BRIEF DESCRIPTION OF THE DRAWINGS

This description will be provided in view of the appended drawings, wherein.

DETAILED DESCRIPTION OF PREFERRED EMBODIMENTS

Figure 1:
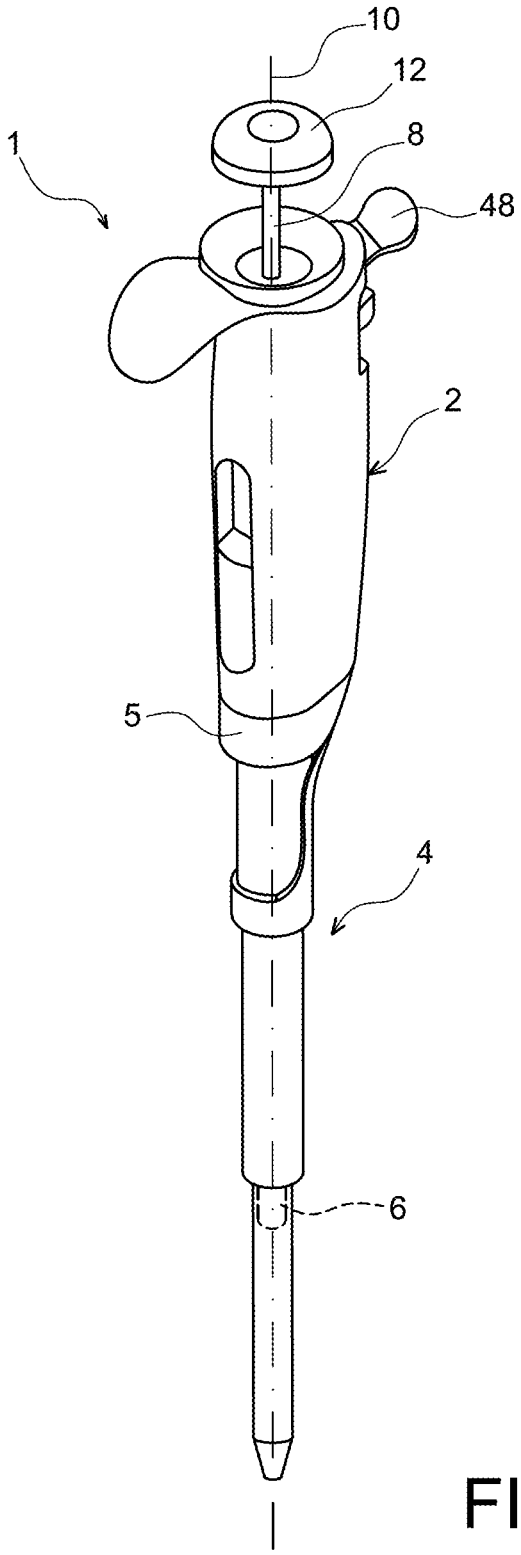
FIG. 1 shows a perspective view of a positive-displacement sampling pipette, according to a preferred embodiment of the present invention.

In reference first to FIG. 1, a positive-displacement sampling pipette 1 is shown according to a preferred embodiment of the present invention.

Throughout the following description, the terms "top" and "bottom" are to be considered with the pipette held vertically, in the pipetting position or close to this position.

The pipette 1 has an exterior body, the top part of which forms a handle 2 for the operator, and the bottom part 4 of which is narrower, ending toward the bottom with an end-fitting 6 on which a capillary is intended to be fitted. The bottom part 4 is preferably screwed onto the handle-forming body 2, by a threaded ring 5, so as to facilitate the assembly/disassembly.

The pipette integrates a control rod 8, slideably housed inside the exterior body of the pipette. The rod 8 is arranged according to the longitudinal axis 10 of the pipette. Its top end projects upward from the handle-forming body 2, and has a control button 12 intended to be actuated by the thumb of an operator holding the body 2 with one hand. The rod 8 is slideably housed through a screw for adjusting the volume to be sampled (not shown). As partially shown in FIG. 2, the rod 8 may include a stroke reduction box 11, for facilitating the rod displacement operation performed by the operator.

In a known manner, the rotation of the control rod 8 by its button 12 enables the adjustment screw to be displaced with respect to the exterior body of the pipette according to axis 10, and thus causes the volume of the sample to be collected to be modified.

The bottom end of the control rod 8 bears axially against a gripping device in the form of a clamp 20, slideably mounted in a bore hole 18 of the hollow body 19 of the bottom part integrating the end-fitting 6 at its bottom end.

Figure 2:
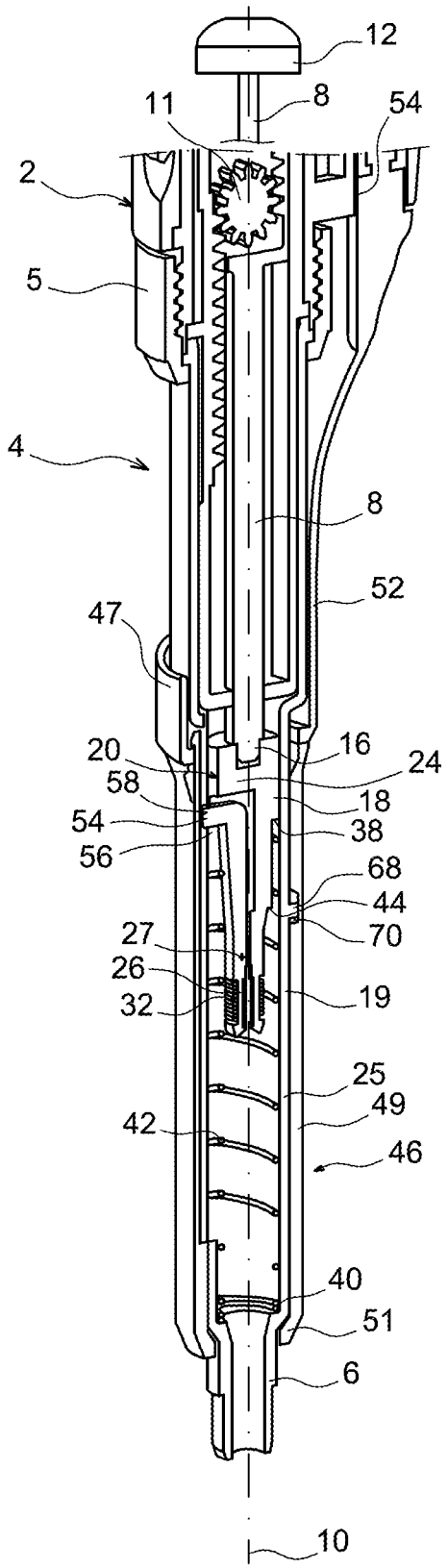
FIG. 2 shows a cross-section view of the bottom part of the pipette shown in the previous figure, with the pipette in a configuration free of the capillary-piston assembly, and with the control button in the top position.

As is shown in FIG. 2, the clamp 20 has a body 24 in contact with the bottom end 16 of the control rod, extended downward by one or more stationary jaws, also referred to as a jaw assembly. As an indicative example, a stationary jaw 25 is provided, made in a single piece with the clamp body 24, said stationary jaw extending, for example, over an angular sector on the order of 270° or more. In addition, the clamp 20 comprises a mobile jaw 26 pivotably mounted on the body 24, according to an axis 27 orthogonal to the axis 10. As will be described in detail below, by pivoting according to said axis 27, the mobile jaw 26 may adopt a first position bringing the clamp into the closed configuration, as well as a second position shown in FIG. 2 bringing the clamp into the open configuration.

Resilient return means 32 enable the mobile jaw 26 to be returned to its first position ensuring a gripping of the clamp 20. To do this, the resilient return means urge the jaws/jaw assembly 25, 26 radially inwardly, preferably by surrounding said same jaw assembly. They may thus be a spring 32 with a general annular shape, the diameter of which may be increased when it is stressed radially outwardly. In the example shown in FIG. 2, the spring 32 takes the form of a spiral spring clamping the exterior surface of the jaws 25, 26.

In addition, each jaw 25, 26 has a chamfered end so as to facilitate the insertion of the piston, as will be explained below.

In addition, the clamp body 24 has a first shoulder 38 facing downward, opposite and at a distance from a shoulder 40 formed on the bottom part 4, near the end-fitting 6. A return spring 42 is housed in contact between said two shoulders 38, 40, so as to form a return spring in the top position of said clamp 20 and the control rod located in contact, in its extension. The return force developed by said compression spring 42 effectively causes the control rod 8 to adopt its top position with respect to the exterior body, a conventional top stop (not shown) being provided for this purpose on the same exterior body.

The clamp 20 comprises a second shoulder 44, also facing downward opposite and at a distance from the shoulder 40. The second shoulder 44 is located further down and radially internally with respect to the first shoulder 38. It is thus surrounded by the spring 42. As will be described below, it is intended to form a bottom stop for the clamp 20 and the control rod 8 in contact on said same clamp. In the top position shown in FIG. 2, the clamp 20 is located outside of the end-fitting 6, at a distance from it, toward the top.

One of the particular features of the present invention lies in the presence of ejection means 46 of a capillary-piston assembly, mounted externally around the hollow body 19, and sliding relative to the latter in the direction of the axis 10.

These means 46 comprise an intermediate ring 47 surrounding the hollow body 19 of the bottom part, said ring rotatably bearing, toward the bottom, an ejection sheath 49 also surrounding said body 19. The sheath has a bottom end 51 arranged near the end-fitting 6 and intended to bear on the fitted capillary in order to eject it.

The intermediate ring 47 is borne by an upper arm 52, which extends upward, optionally passing through an orifice 54 of the handle 2, to a top end attached to an ejection button 48. Said button 48 is arranged in the top part of the pipette, near the main control button 12, but distinct from the latter. It is also intended to be simply actuated by the thumb of an operator holding the body 2 with one hand.

Figure 3:
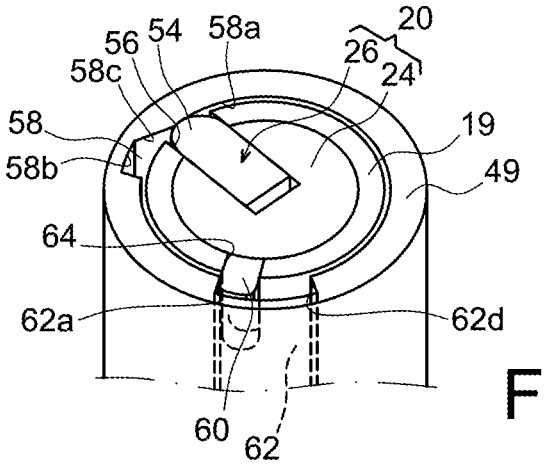
FIG. 3 shows a transverse cross-section view with ramp/pin connections specific to the present invention.
Figure 4:
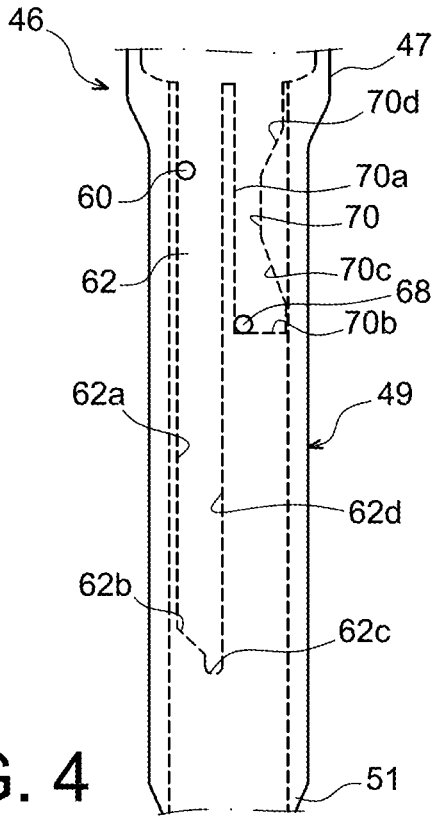
FIG. 4 is a schematic side view of the ejection means, showing ramp/pin connections specific to the present invention.
Figure 5A:
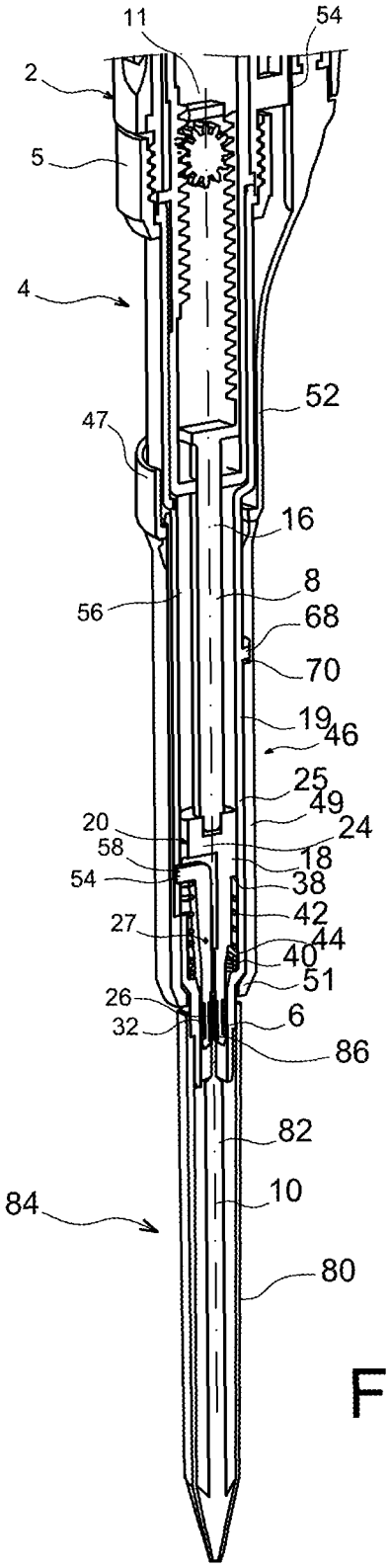
FIGS. 5*a* to 8*d*, based on FIGS. 2 to 4, show the pipette in different configurations during a pipetting cycle.
Figure 5B:
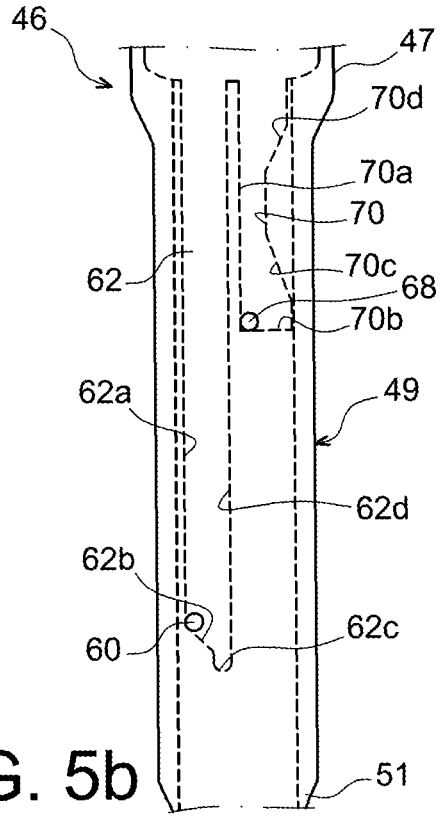
Figure 5C:
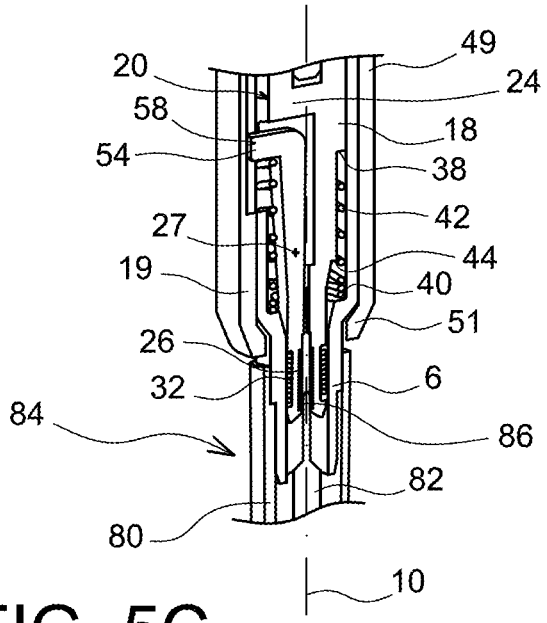
Figure 5D:
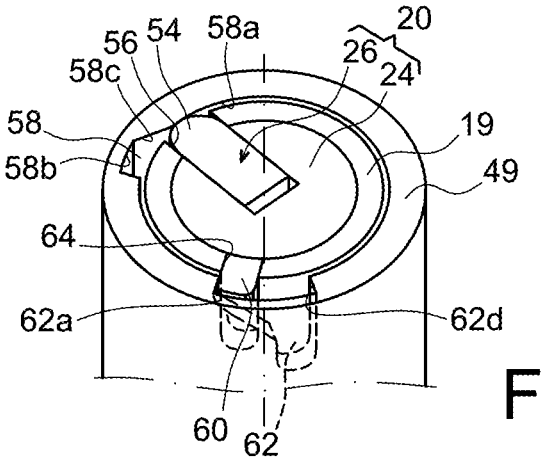
Figure 6A:
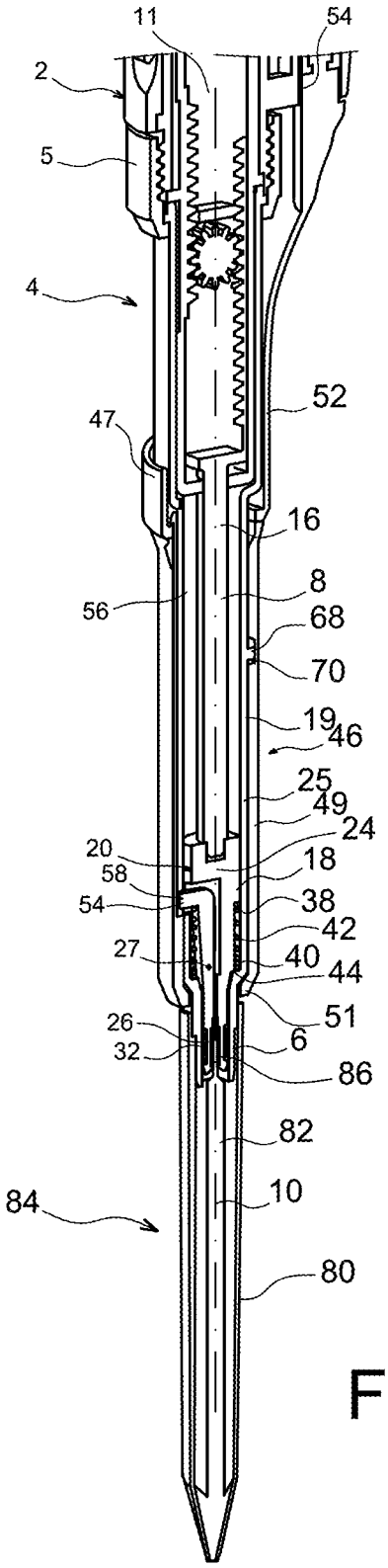
Figure 6B:
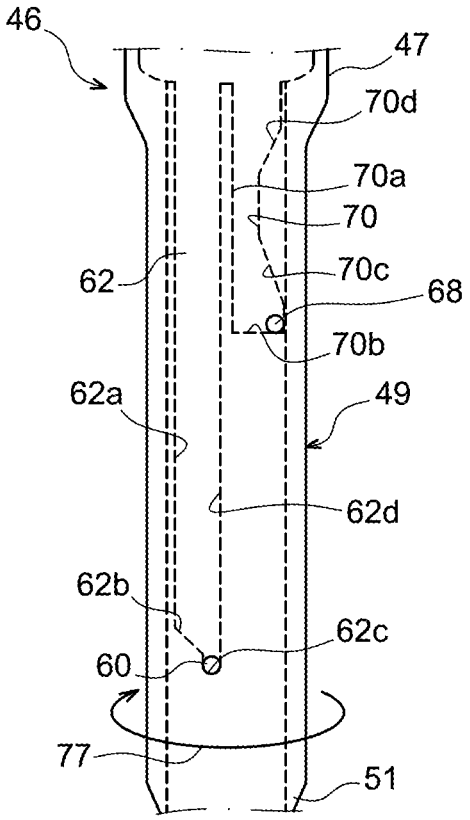
Figure 6C:
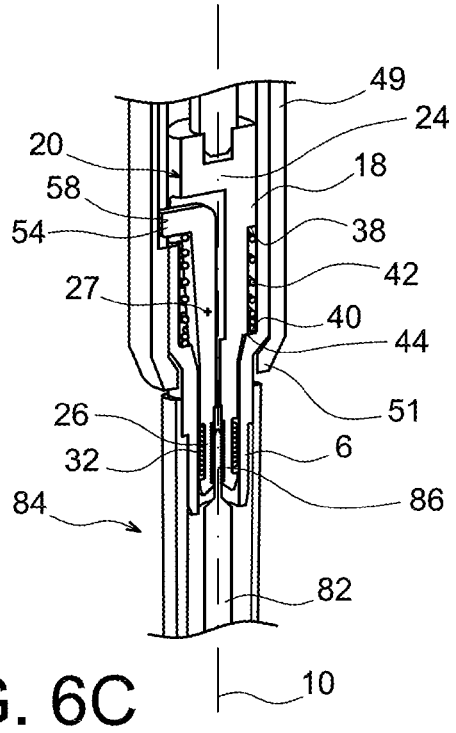
Figure 6D:
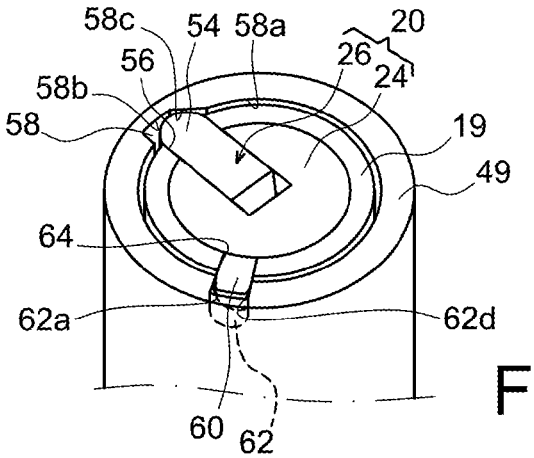
Figure 7A:
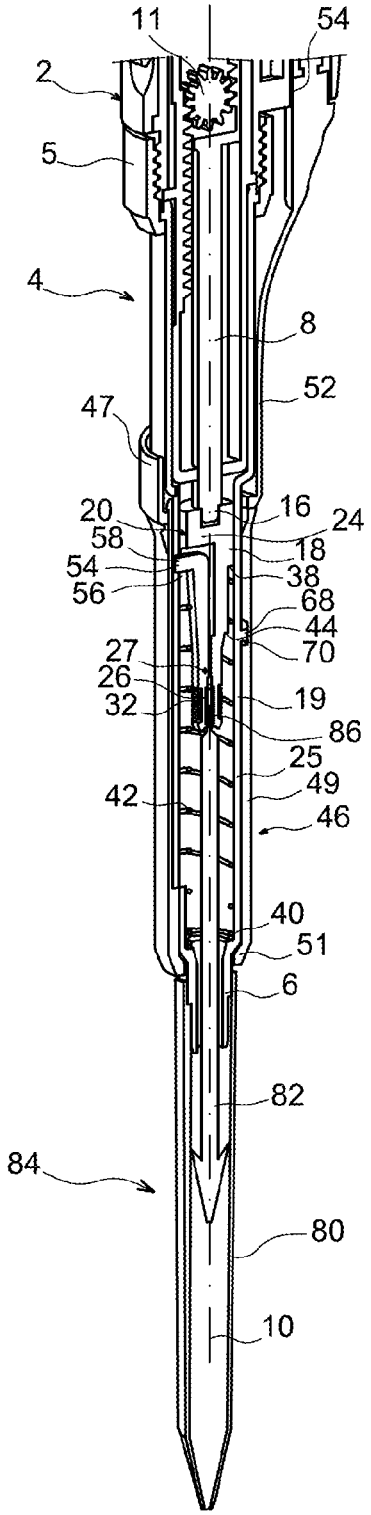
Figure 7B:
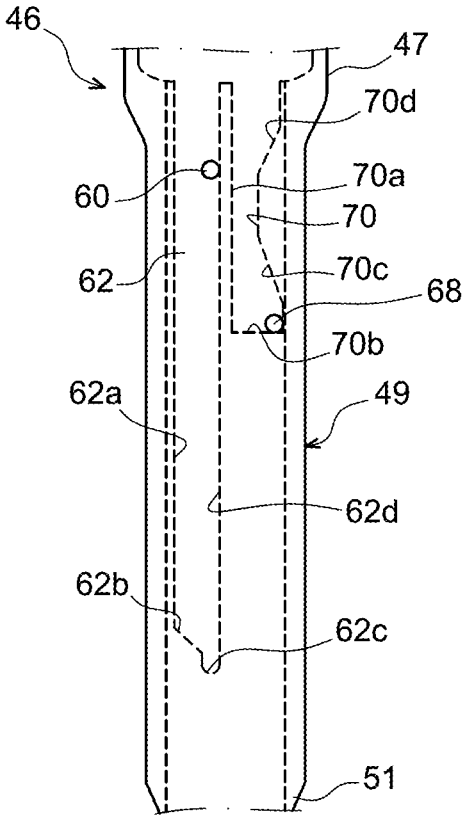
Figure 7C:
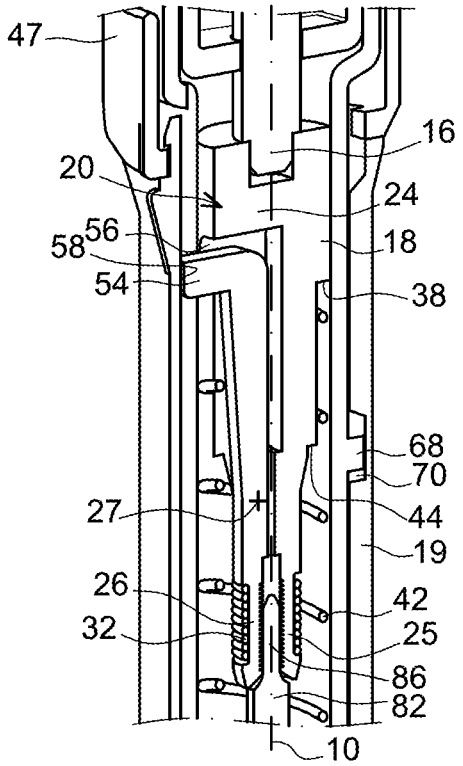
Figure 7D:
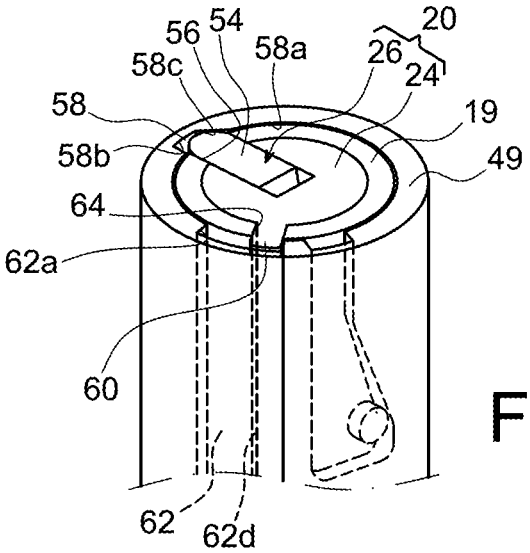
Figure 8A:
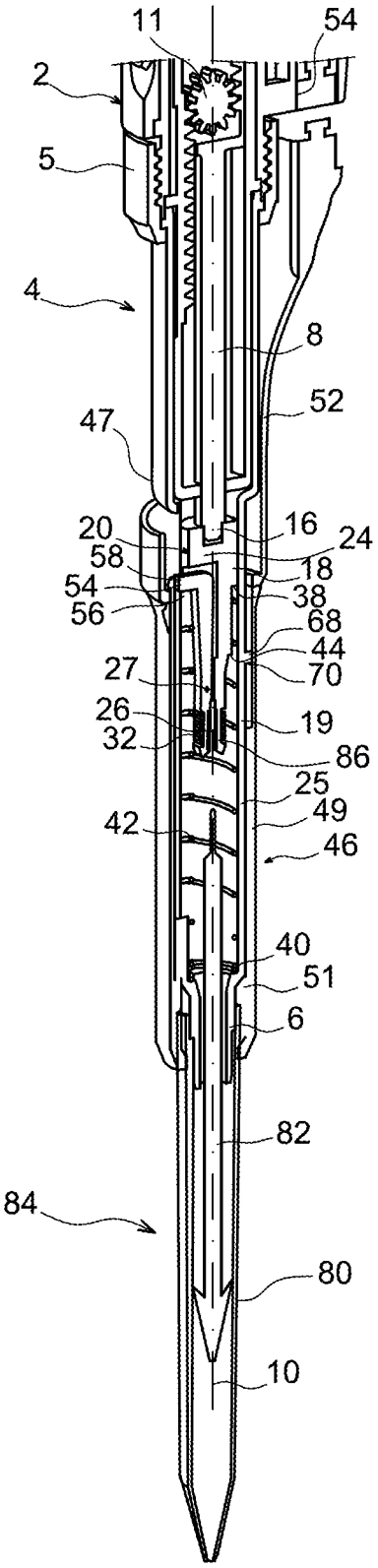
Figure 8B:
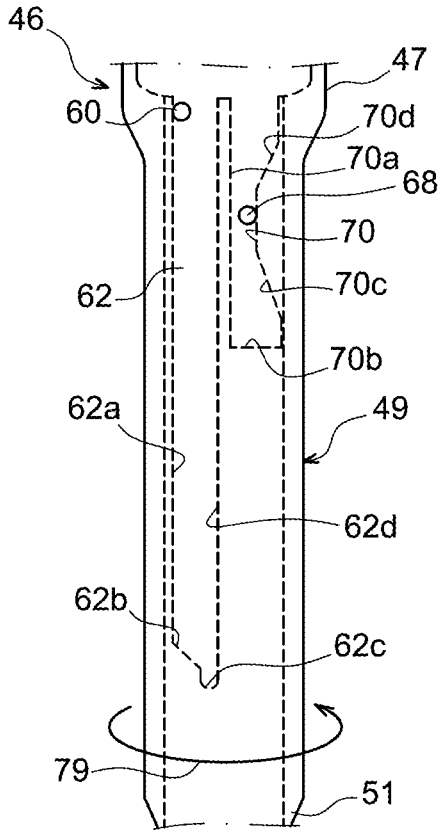
Figure 8C:
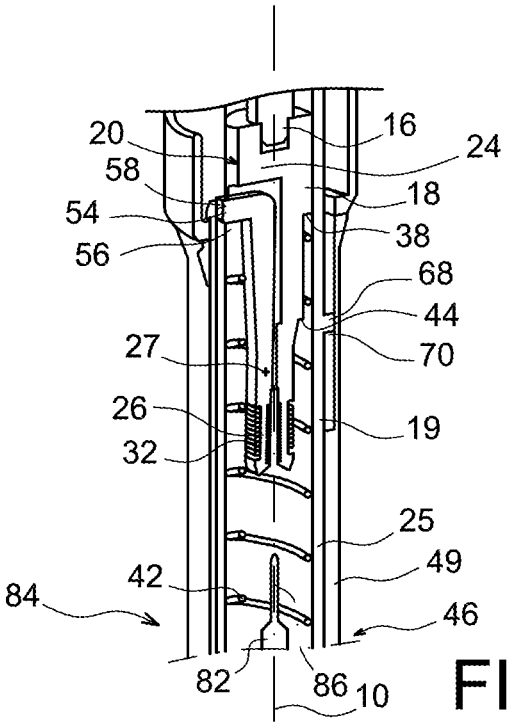
Figure 8D:
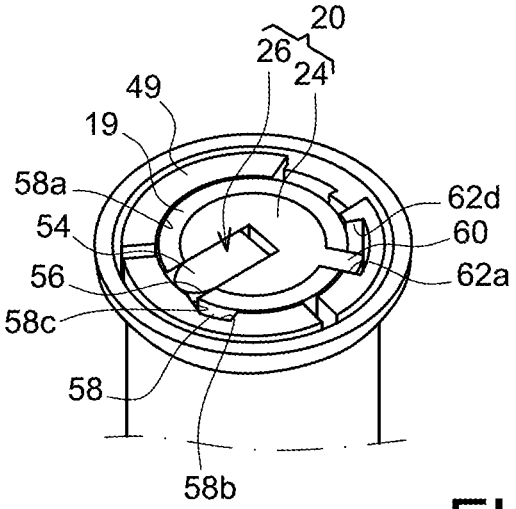

In reference to both FIGS. 2 and 4, different elements specific to the present invention are shown. First, the mobile jaw 26 extends upward, having a first radially outwardly-facing pin 54 passing through a slot 56 formed in the hollow body 19. The pin 54 bears on a first ramp 58 provided on the interior surface of the sheath 49. The ramp 58 is a circumferential ramp, and its pin-receiving surface 54 has, in reference to axis 10, a progressive radial spacing. In fact, as is best seen in FIG. 3, the ramp 58 has, in particular, an area 58*a* close to the axis 10, an area 58*b* at a distance from said same axis, and an area 58*c* of transition between areas 58*a* and 58*b*. These areas 58*a*, 58*c*, 58*b* follow one another in the circumferential direction.

When the pin 54 is in the second position shown in FIGS. 2 and 3, it contacts the close area 58*a* of the ramp 58, causing the bottom end of the jaw 26 to be located farther from the stationary jaw 25, and therefore the clamp to be placed in the open configuration in which the piston of a capillary-piston assembly can easily be inserted. The adoption of this second position of the mobile jaw 26 is tolerated by the deformation of the spring 32 surrounding the jaw assembly.

The mechanical connection formed by the pin 54 and the ramp 58 is such that, when the pin is displaced relative to the ramp toward the distant area 58*b*, it causes a pivoting of the mobile jaw 26 according to axis 27, under the action of the return force of the spring 32. The mobile jaw 26 is thus displaced from its second position to its first position by a relative displacement of the pin 54 along the ramp 58, and the reverse. In the first position, which will be described below, the jaws 25, 26 close to one another place the clamp 20 in the closed configuration ensuring the holding of the piston in the clamp by friction.

In addition, another mechanical connection is provided, including a second pin 60 projecting radially outwardly from the clamp body 24, and passing through a slot 64 formed in the hollow body 19. A second ramp 62 is associated with the pin 60. The pin 60 bears on said second ramp 62, also provided on the interior surface of the sheath 49.

The ramp 62 has a complex shape that will be described in detail in reference to FIG. 4. First, it has a general U-shape, with a first flank 62*a* positioned parallel to the axis 10, and formed in the thickness of the hollow body 19. In the bottom part, the first flank 62*a* is followed by an actuation area 62*b*, which is both axially and circumferentially inclined. It is an area similar to a helical ramp portion. Optionally, at the outlet of this actuation area 62*b*, the ramp 62 includes a holding area 62*c* extending axially downward, and having a width corresponding substantially to that of the pin 60. Then, the second axial flank 62*d*, parallel to the first, is provided.

When the control button is in the top position, like the clamp 20 in the open configuration as shown in FIGS. 2 to 4, the pin 60 bears on a top part of the first flank 62*a*.

In addition, another mechanical connection is provided, including a third pin 68 projecting radially outwardly from the hollow body 19. A third ramp 70 is associated with the pin 68. The pin 68 bears on said third ramp 70 also provided on the interior surface of the sheath 49.

The ramp 70 has a complex shape that will be described in detail in reference to FIG. 4. First, it has a general U-shape, with a first flank 70*a* positioned parallel to the axis 10, and formed in the thickness of the hollow body 19. In the bottom part, the first flank 70*a* is connected to a base 70*b* positioned transversally in a plane orthogonal to the axis 10. Opposite the first flank 70*a* is a second flank having a bottom actuation part 70*c*, which is both axially and circumferentially inclined. Its circumferential inclination is produced in a direction opposite that of the inclination of the actuation area 62*b* of the second ramp. In this case it is also an area similar to a helical ramp portion. The second flank then extends with a dead zone 70*d* symmetrical with the actuation area 70*c*, relative to a transverse plane of the pipette. The dead zone enables the insertion of the pin 68 during assembly of the pipette to be facilitated.

In reference now to FIGS. 5*a* to 8*d*, the operation of the pipette 1 will be described.

First, in reference to FIGS. 5*a* to 5*d*, the operator holding the pipette by the handle 2 engages the end-fitting 6 in a capillary 80 of a capillary-piston assembly 84, preferably arranged in a box, also called a "rack". By exerting a vertical downward pressure on the pipette, the capillary 80 is fitted onto the end-fitting 6, like the fitting of a capillary or a conventional cone on the end-fitting of a conventional air-displacement pipette.

Then, the operator presses on the control button 12 so as to bring the control rod 8 and the clamp 20 toward the bottom position. This displacement causes a movement of the second pin 60 along the first flank 62*a* of the second ramp 62 to the bottom of said first flank. During this first descent phase of the clamp, the angular position of the sheath 49 with respect to the body 19 and the clamp 20 is maintained. The mobile jaw 26 does not therefore undergo any displacement along its pivot axis 27, and its second position is retrained by the bearing of the pin 54 on the close area 58*a* of the first ramp 58. The relative position of the third pin 68 on the ramp 70 remains unchanged, namely, the pin 68 bears against the base 70*b* and the first flank 70*a*. During this first descent phase of the clamp allowed by the compression of the spring 42, the top end 86 of the piston 82 has begun its insertion between the jaws 25, 26, which are spaced apart.

When the displacement of the rod 8 and the clamp 20 is continued downward, still against the spring 42, the second pin 60 bears on the actuation area 62*b* of the second ramp 62, as shown in FIGS. 6*a* to 6*d*. The bearing caused by the relative displacement of the pin 60 along the ramp area 62*b* pushes the sheath 49 so as to rotate in the direction of the arrow 77 of FIG. 6*b*. Also, during this second descent phase of the clamp 20 in which the end of the insertion of the top end 86 of the piston 82 in the clamp 20 is performed, a rotation of the sheath 49 according to axis 10 is also automatically created, which causes the clamp to be brought into the closed configuration. In fact, during said rotation of the sheath 49, the clamp 20 remains fixed in rotation according to axis 10, but the pin 54 is displaced along the ramp 58 so as to reach the distant area 58*b*, while pivoting according to its axis 27 under the effect of the spring 32. Still during this automatic rotation of the sheath, which remains axially fixed, the third pin 68 is displaced along the base 70*b* of the ramp until it arrives in contact with the bottom of the actuation area 70*c*.

In the end-of-stroke position shown in FIGS. 6*a* to 6*d*, the closed clamp 20 holding the piston 82 is in bottom abutment on the lower body 19, by contact between the shoulders 44, 40.

At the end of this step, the piston is located in the bottom stop position in the capillary. Thus, to simplify the sampling process, the control rod 8 is preferably held in the bottom position until the sample is collected, during which the control rod rises with the piston so as to create the aspiration of the liquid.

During this rise of the piston and the clamp schematically shown in FIGS. 7*a* to 7*d*, the closed configuration of said clamp 20 is of course maintained in order to hold the piston by friction. During the rise, the second pin 60 is displaced along the second flank 62*d* of the ramp 62, while the relative position of the third pin 68 and the third ramp 70 remains unchanged. No relative rotation movement is therefore produced between the sheath 49 and the clamp 20 or the body 19.

It is then the dispensing of the sampled liquid that is performed, in a manner identical to that performed for the gripping of the piston, but with the mobile jaw 26 held in its first position of clamping the piston. In fact, the stroke is the same, bringing the control rod 8 into the bottom position until it comes into contact between the shoulders 44, 40.

Finally, the ejection of the entire consumable 84 is performed, using ejection means 46 actuated by the ejection button 48. This ejection step is schematically shown in FIGS. 8*a* to 8*d*.

The axial bearing on the ejection button 48 causes the ring 47 and the sheath 49 to slide downward, according to axis 10. But during this descent of the ejection means, the bearing caused by the relative displacement of the pin 68 along the actuation area 70*c* of the third ramp 70 pushes the sheath 49 so as to rotate according to the direction of the arrow 79 in FIG. 8*b*, i.e. in a direction opposite that shown in FIG. 6*b* when the capillary-piston assembly is placed on the pipette. Also, during this descent phase of the ejection means, a rotation of the sheath 49 according to axis 10 is automatically created, which causes the clamp to be brought into the open configuration. Indeed, during this rotation of the sheath 49, which in fact undergoes a helical displacement according to axis 10, the clamp 20 and the body 19 remain fixed in rotation according to axis 10, but the pin 54 is displaced along the ramp 58 so as to reach the close area 58*a* of the first ramp, while pivoting according to its axis 27 against the return force of the spring 32. Also during this downward displacement of the sheath 49, which bears with its bottom end 51 on the capillary 80 for ejection thereof, the second pin 60 is displaced circumferentially so as to again reach the first flank 62*a*, at a top part thereof.

In other words, during the helical movement of the sheath 49, a thrust of the capillary via the bottom end 51 of the sheath and an opening of the clamp 20 releasing the top end 86 of the piston 82 are created. The assembly 84 may thus be easily ejected, in an innovative manner specific to the present invention.

Finally, it is indicated that, as the ejection means rise, the open configuration of the clamp 20 is of course retrained in order to keep the pipette ready for a future use. During this rise, the third pin 68 is displaced along the first flank 70*a* that it has already contacted at the end of the ejection operation, due to the low width between the top end of the actuation area 70*c* and the first flank 70*a*. Once the ejection means have returned to the top position, the pin 68 is again at the junction between the flank 70*a* and the base 70*b*. Moreover, during the rise of the ejection means 46, the relative position of the second pin 60 and the second ramp 62 remains unchanged. No relative rotation movement between the sheath 49 and the clamp 20 or the body 19 is therefore produced.

Of course, various modifications may be made by a person skilled in the art to the invention described above, solely as non-limiting examples.

The invention claimed is:

1. A bottom part of a positive-displacement pipetting system, comprising:

a body slideably housing a device for gripping a top end of a piston belonging to a capillary-piston assembly, the body comprising an end-fitting adapted to receive a capillary to be fitting thereonto; and a ring surrounding the body and rotatably bearing an ejection sheath also surrounding the body and constructed to eject the capillary-piston assembly arranged externally with respect to said body and slideably mounted relative to said body according to a longitudinal axis of the pipetting system, so as to be capable of cooperating with said capillary for ejection thereof, wherein said bottom part comprises at least one of a first ramp, a second ramp, and a third ramp, and is constructed so that a relative rotation between the ejection sheath and the gripping device, according to the longitudinal axis of the pipetting system, causes the gripping device to pass from an open configuration enabling the top end of the piston to a closed configuration enabling said end to be retained, and/or to pass from the closed configuration to the open configuration.

2. The bottom part of a pipetting system according to claim 1, wherein the gripping device comprises a jaw mobile between a first position bringing the device into the closed configuration and a second position bringing the device into the open configuration, the mobile jaw comprising one of two elements among a first pin passing through said body and the first ramp cooperating with said first pin, the other of the two elements being provided on said ejection sheath, and wherein passage of the mobile jaw from the first position to the second position, and the reverse, is caused by a relative displacement of the first pin along said first ramp.

3. The bottom part of a pipetting system according to claim 2, wherein the gripping device is equipped with resilient return means returning the mobile jaw to its first position or to its second position.

4. The bottom part of a pipetting system according to claim 1, wherein the gripping device comprises one of two elements among a second pin passing through said body and the second ramp cooperating with the second pin, the other of the two elements being provided on said ejection sheath, and wherein the bottom part of the pipetting system is constructed so that, during a downward displacement of the gripping device, the gripping device passes from its open configuration to its closed configuration by a relative rotation between the ejection sheath and the gripping device caused by the relative displacement of the second pin along said second ramp.

5. The bottom part of a pipetting system according to claim 4, wherein the second ramp is constructed so that, after the gripping device passes into the closed configuration, this closed configuration is maintained as the gripping device rises.

6. The bottom part of a pipetting system according to claim 1, wherein said body comprises one of two elements among a third pin and the third ramp cooperating with the third pin, the other of the two elements being provided on said ejection sheath, and wherein the bottom part of the pipetting system is constructed so that, during a downward displacement of the ejection means, said gripping device is brought from the closed configuration to the open configuration by a rotation of the ejection sheath relative to said body, caused by a relative displacement of the third pin along said third ramp.

7. The bottom part of a pipetting system according to claim 6, wherein the third ramp is constructed so that, after the gripping device passes into the open configuration, this open configuration is maintained as the ejection sheath rises.

8. The bottom part of a pipetting system according to claim 1, wherein the first, second, and third ramps are each provided on an interior surface of the ejection sheath.

9. The bottom part of a pipetting system according to claim 1, further comprising a ring surrounding the body and rotatably bearing the ejection sheath also surrounding the body.

10. A positive-displacement pipetting system, comprising:

a bottom part of a positive-displacement pipetting system, comprising a body slideably housing a device for gripping a top end of a piston belonging to a capillary-piston assembly, a capillary of which is adapted to be fitted onto an end-fitting of the body; and a ring surrounding the body and rotatably bearing an ejection sheath also surrounding the body and constructed to eject the capillary-piston assembly arranged externally with respect to said body and slideably mounted relative to said body according to a longitudinal axis of the pipetting system, so as to be capable of cooperating with said capillary for ejection thereof, wherein said bottom part is constructed so that a relative rotation between the ejection sheath and the gripping device, according to the longitudinal axis of the pipetting system, causes the gripping device to pass from an open configuration enabling the top end of the piston to a closed configuration enabling said end to be retained, and/or to pass from the closed configuration to the open configuration.

11. The pipetting system according to claim 10, further comprising a pipette, manual or powered, comprising a handle-forming top part equipped with an ejection button connected to said ejection sheath.

12. The pipetting system according to claim 11, wherein said ejection button is distinct from a button for controlling the displacement of the piston.

13. The pipetting system according to claim 10, wherein said pipetting system is an automated system.

14. A pipetting method comprising the following successive steps:

(a) fitting of a capillary of a capillary-piston assembly on an end-fitting of the pipetting system, and inserting of a top end of a piston of the assembly into the gripping device during the displacement thereof to a bottom position, during which insertion a relative rotation is performed between an ejection sheath and the gripping device in order to bring the gripping device from the open configuration to the closed configuration, so as to retain the top end of the piston;

(b) collecting and dispensing of a sample by actuation of a control rod connected to the gripping device; and (c) ejecting of the capillary-piston assembly by downward displacement of said ejection sheath thrusting a capillary, during which ejection a relative rotation is performed between said ejection sheath and the gripping device in order to bring the gripping device from the closed configuration to the open configuration releasing the top end of the piston, wherein the positive-displacement pipetting system comprises a bottom part, comprising a body slideably housing the gripping device for gripping the top end of the piston belonging to the capillary-piston assembly, the capillary of which is adapted to be fitted onto the end-fitting of the body; and a ring surrounding the body and rotatably bearing the ejection sheath also surrounding the body and constructed to eject the capillary-piston assembly arranged externally with respect to said body and slideably mounted relative to said body according to a longitudinal axis of the pipetting system, so as to be capable of cooperating with said capillary for ejection thereof, wherein said bottom part is constructed so that a relative rotation between the ejection sheath and the gripping device, according to the longitudinal axis of the pipetting system, causes the gripping device to pass from an open configuration enabling the top end of the piston to a closed configuration enabling said end to be retained, and/or to pass from the closed configuration to the open configuration.

15. The method according to claim 14, wherein, for step (a), said relative rotation between said ejection sheath and the gripping device is performed automatically as the gripping device descends, and wherein, for step (c), said relative rotation between said ejection sheath and the gripping device is performed automatically as the ejection sheath descends.

* * * * *